US008486236B1

(12) United States Patent
Warning

(10) Patent No.: US 8,486,236 B1
(45) Date of Patent: Jul. 16, 2013

(54) ELECTROLYSIS CHAMBER

(76) Inventor: Walter B. Warning, Edgewater, FL (US)

( * ) Notice: Subject to any disclaimer, the term of this patent is extended or adjusted under 35 U.S.C. 154(b) by 177 days.

(21) Appl. No.: 12/802,982

(22) Filed: Jun. 17, 2010

(51) Int. Cl.
*C25B 9/20* (2006.01)
*C25B 1/26* (2006.01)

(52) U.S. Cl.
USPC ..... 204/253; 205/500

(58) Field of Classification Search
USPC ..... 205/513, 514
See application file for complete search history.

(56) References Cited

U.S. PATENT DOCUMENTS 583,513 A * 6/1897 Spilker ..... 205/159
3,864,236 A * 2/1975 Lindstrom ..... 204/265
4,137,145 A * 1/1979 Wallace ..... 204/279
4,197,169 A * 4/1980 Zahn et al. ..... 205/343
4,312,735 A * 1/1982 Grimes et al. ..... 204/230.2
4,375,882 A * 3/1983 Schreiber, Jr. ..... 251/266
4,498,706 A * 2/1985 Ilardi et al. ..... 299/5
5,421,977 A * 6/1995 Getsy et al. ..... 204/263
5,756,874 A * 5/1998 Steward ..... 588/302
5,776,328 A * 7/1998 Traini et al. ..... 205/514
2002/0175072 A1* 11/2002 Sioli ..... 204/271
2007/0186367 A1* 8/2007 Field et al. ..... 15/320
2011/0259760 A1* 10/2011 Swartz et al. ..... 205/748

* cited by examiner

*Primary Examiner* — Harry D Wilkins, III

(57) ABSTRACT

A electrolysis chamber. The electrolysis chamber has first initial product sub-chambers, second initial product sub-chambers, at least one positive electrode, at least one negative electrode, and electrolysis membranes. The first initial product sub-chambers and second initial product sub-chambers communicate with respective manifolds, which in turn communicates with an exterior of the electrolysis chamber through respective ports. Flow control valves set the flow into the first initial product sub-chambers. First, second and third end product manifolds communicate with an exterior of the electrolysis chamber through respective ports. The ports and manifold configuration provides for simple and easy connection and installation of the electrolysis chamber.

10 Claims, 5 Drawing Sheets

ELECTROLYSIS CHAMBER

BACKGROUND OF THE INVENTION

1. Field of the Invention

This invention relates to electrolysis systems, and in particular to an electrolysis chamber.

2. Background of the Invention to Electrolysis is a process wherein electric current is passed through an ionic substance dissolved in an appropriate solvent, which results in chemical reactions at the electrodes immersed in the electrolysis chamber solution, and the production of certain desirable output products.

The principal components required to bring electrolysis about are a source of electrical energy electrically connected to a pair of electrodes extending into a liquid containing mobile ions (an "electrolyte"), which is contained in an electrolysis chamber. When an electrical potential difference is applied across the electrodes, each electrode attracts ions of the opposite charge: the positive electrode (the "anode") attracts negatively-charged ions ("anions"), while the negatively-charged electrode (the "cathode") attracts positively charged ions ("cations").

At the electrodes, electrons are absorbed or released by the atoms and ions. Those atoms that gain or lose electrons to become charged ions pass into the electrolyte. Those ions that gain or lose electrons to become uncharged atoms separate from the electrolyte. The formation of uncharged atoms from ions is called discharging.

The electrolysis products are collected at the electrodes. For example where the electrolysis of brine produces hydrogen and chlorine gas, the gas bubbles rise to the surface of the electrolyte for collection.

In order to employ electrolysis chambers in a useful manner, it is necessary to provide entry into the electrolysis chamber for the initial products, which may be salt in a water solution and water; and exit from the chamber for the electrolysis products, which may be a chemical A such as hypochlorous acid (HC10) and sodium hydroxide (NAOH), and by-products sich as brine (salt in a water solution).

It is common industry practice to install electrolysis electrodes together in series within the same electrolysis chamber, in interest of efficiency. The electrodes are separated by membranes, which also serve to separate the initial products and electrolysis products into appropriate electrolysis sub-chambers.

FIG. 3 schematically depicts a four-electrode electrolysis chamber, and FIG. 4 schematically depicts a three-electrode chamber. It may be appreciated from these figures that routing the correct initial electrolysis products into the appropriate electrolysis sub-chambers is a non-trivial activity. Similarly, extracting electrolysis end products from the appropriate sub-chambers can become complicated, unless a common routing is established for each electrolysis end product.

Accordingly, it would be desirable to provide a single inlet port for each electrolysis initial product, and appropriate passaging to distribute each electrolysis initial product from each inlet port to corresponding electrolysis sub-chambers.

Similarly, it would be desirable to provide a single outlet port for each electrolysis end product, and appropriate passaging to distribute each electrolysis end product from its corresponding electrolysis sub-chambers to its single outlet port.

In addition, it would be desirable to provide a means to set the flow rate of the first initial product into each first initial product sub-chamber, so that input rate and production rate can be set in each first initial product sub-chamber.

SUMMARY OF THE INVENTION

Accordingly, it is an object of the present invention to provide an electrolysis chamber which provides a single inlet port for each electrolysis initial product, and appropriate passaging to distribute each electrolysis initial product from each inlet port to corresponding electrolysis sub-chambers. Design features allowing this object to be accomplished include a first electrolysis product inlet port into a first initial product manifold, and a plurality of first initial product sub-chambers communicating with the first initial product manifold; and a second electrolysis product inlet port into a second initial product manifold, and a plurality of second initial product sub-chambers communicating with the second initial product manifold. Advantages associated with the accomplishment of this object include simplicity of connection and use of the electrolysis chamber, and associated time and cost savings.

It is another object of the present invention to provide an electrolysis chamber which provides a single outlet port for each electrolysis end product, and appropriate passaging to distribute each electrolysis end product from its corresponding electrolysis sub-chambers to its single outlet port. Design features allowing this object to be accomplished include a plurality of first initial product sub-chambers adjacent respective positive electrodes communicating with a first end product manifold and a first end product outlet port; a plurality of first initial product sub-chambers adjacent respective negative electrodes communicating with a second end product manifold and a second end product outlet port; and a plurality of second initial product sub-chambers, each disposed between a positive and a negative electrode and separated from these by membranes, which communicate with a third end product manifold and a third end product outlet port.

Benefits associated with the accomplishment of this object include simplicity of connection and use of the electrolysis chamber, and associated time and cost savings.

It is still another object of this invention to provide an electrolysis chamber which permits flow adjustment into each first initial product sub-chamber. Design features enabling the accomplishment of this object include a flow control valve between a first initial product manifold and each first initial product sub-chamber. Advantages associated with the realization of this object include operator ability to regulate flow of first initial product into each first initial product sub-chamber, increased accuracy of reaction in each first initial product sub-chamber, and associated cost sayings.

It is yet another object of this invention to provide an electrolysis chamber which is inexpensive to produce. Design features allowing this object to be achieved include the use of components made of readily available materials. Benefits associated with reaching this objective include reduced cost, and hence increased availability.

BRIEF DESCRIPTION OF THE DRAWINGS

The invention, together with the other objects, features, aspects and advantages thereof will be more clearly understood from the following in conjunction with the accompanying drawings.

Five sheets of drawings are provided. Sheet one contains FIG. 1. Sheet two contains FIG. 2. Sheet three contains FIG. 3. Sheet four contains FIG. 4. Sheet five contains FIG. 5.

DETAILED DESCRIPTION OF THE PREFERRED EMBODIMENT

Figure 1:
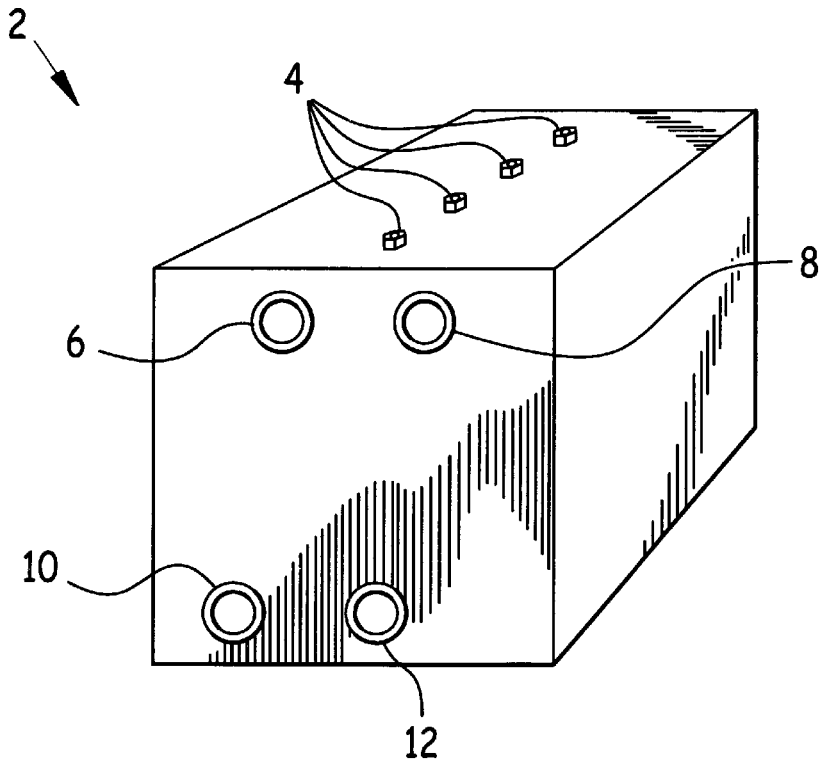
FIG. 1 is a front quarter elevated isometric view of an electrolysis chamber with inlet and outlet ports.
Figure 2:
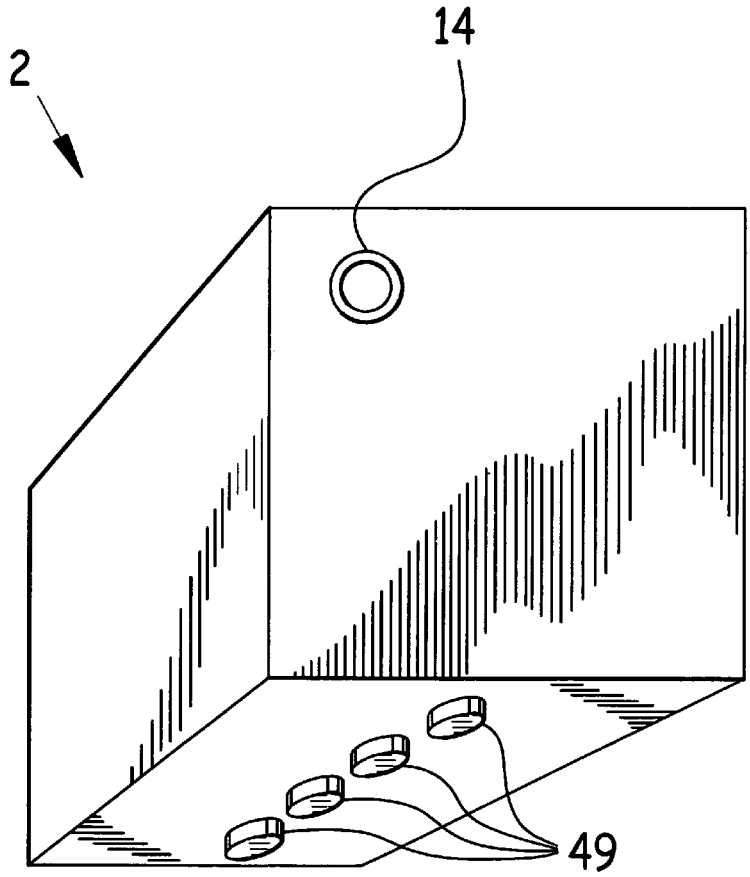
FIG. 2 is a rear quarter upward view of an electrolysis chamber.

FIG. 1 is a front quarter elevated isometric view of electrolysis chamber 2. FIG. 2 is a rear quarter upward view of electrolysis chamber 2. As may be observed in these figures, electrolysis chamber 2 comprises first initial product inlet port 10 and second initial product inlet port 12 for initial products for the electrolysis process; and first end product outlet port 6, second end product outlet port 8, and third end product outlet port 14 for the products resulting from the electrolysis.

One example of these products may be water as a first initial product and salt in water solution as a second initial product; and hypochlorous acid as a first end product, sodium hydroxide as a second end product, and brine solution as a third end product. Two important advantages of the instant design are the single inlet ports for each initial product, and the single outlet ports for each end product.

Figure 3:
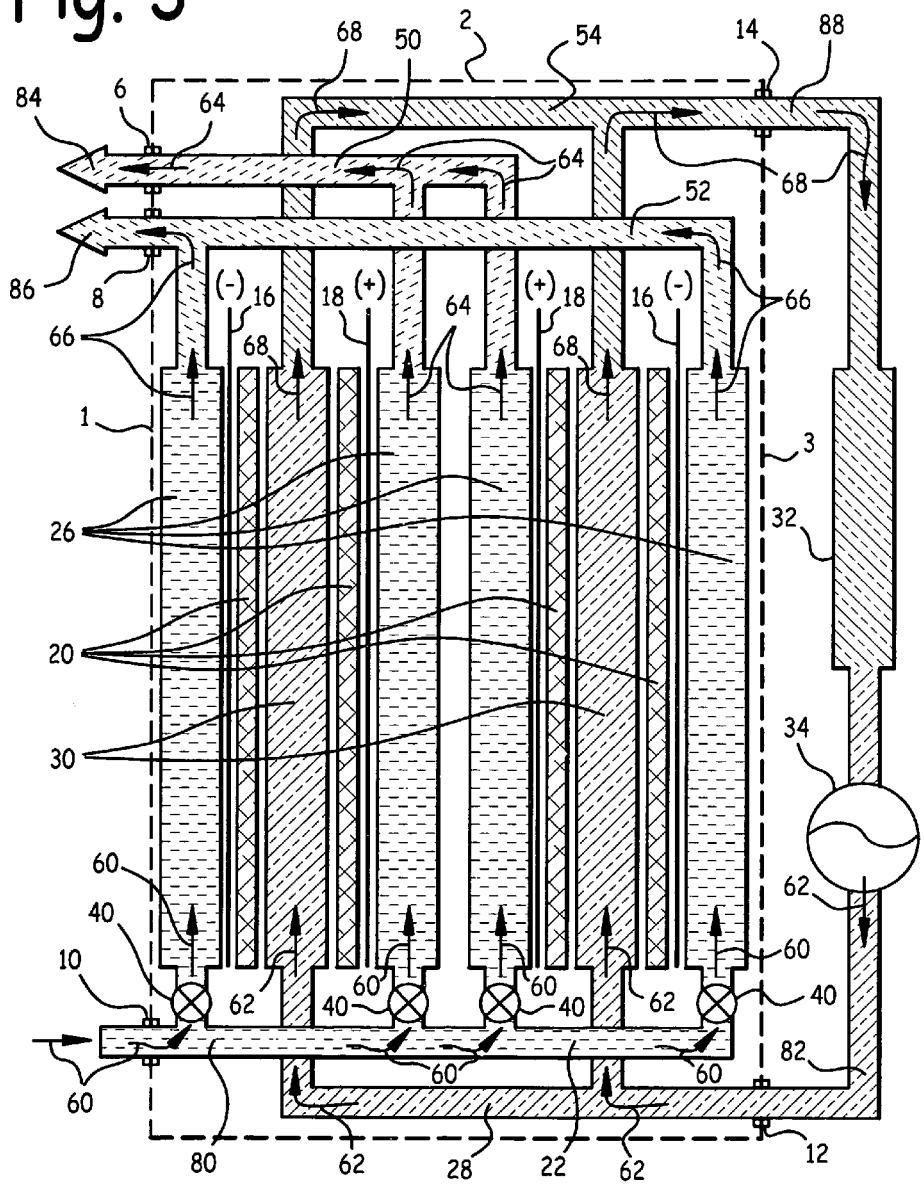
FIG. 3 is a side cross-sectional schematic view of a four-electrode electrolysis chamber, showing passaging between inlet and outlet ports, and sub-chambers.

In the embodiment depicted in FIGS. 1, 2 and 3, the electrolysis chamber 2 shown is a four-electrode electrolysis chamber. Accordingly, four electrode contacts 4 are illustrated in FIG. 1.

FIG. 3 is a side cross-sectional schematic view of a four-electrode electrolysis chamber 2, showing passaging between inlet and outlet ports, and sub-chambers.

The four-electrode electrolysis chamber 2 depicted in FIGS. 1-3 comprises electrodes, electrolysis sub-chambers, and membranes arrayed side-by-side from electrolysis chamber first side 1 to electrolysis chamber second side 3 in the following order: first initial product sub-chamber 26, negative electrode 16, membrane 20, second initial product sub-chamber 30, membrane 20, positive electrode 18, first initial product sub-chamber 26, first initial product sub-chamber 26, negative electrode 16, membrane 20, second initial product sub-chamber 30, membrane 20, positive electrode 18, and first initial product sub-chamber 26.

A single first initial product inlet port 10 provides access from the exterior of electrolysis chamber 2 to first initial product manifold 22. First initial product manifold 22 communicates with a plurality of first initial product sub-chambers 26 through flow control valves 40. One flow control valve 40 is associated with each first initial product sub-chamber 26, and sets the flow rate of first initial product 80 into its respective first initial product sub-chamber 26.

A single second initial product inlet port 12 provides access from the exterior of electrolysis chamber 2 to second initial product manifold 28. Second initial product manifold 28 communicates with a plurality of second initial product sub-chambers 30.

A single first end product outlet port 6 provides exit for first end product 84 from the first initial product sub-chambers 26 which are adjacent positive electrodes 18, through first end product manifold 50. A single second end product outlet port 8 provides exit for second end product 86 from the first initial product sub-chambers 26 which are adjacent negative electrodes 16, through second end product manifold 52. A single third end product outlet port 14 provides exit for third end product 88 from second initial product sub-chambers 30 through third end product manifold 54 and third end product outlet port 14.

Described in broad brush strokes, initial products enter respective electrolysis sub-chambers, undergo electrolysis, and emerge as end products. In one possible embodiment of this process, second initial product 82 may be salt in water solution, which emerges from second initial product sub-chambers 30 as third end product 88 which may be brine, and thence proceeds to second initial product reservoir 32, which may be a salt tube.

In operation, first initial product 80 is supplied from a source external to electrolysis chamber 2 through first initial product inlet port 10 and first initial product manifold 22 and into first initial product sub-chambers 26 as indicated by arrows 60. Second initial product 82 is pumped by pump 34 from second initial product reservoir 32 into second initial product manifold 28, and from thence into second initial product sub-chambers 30 as indicated by arrows 62.

In each electrolysis sub-chamber, the initial products are electrolyzed into end products, and the specific end product flowing from each first initial product sub-chamber 26 depends on the polarity of electrode adjacent the specific first initial product sub-chamber 26. First initial product 80 passing through first initial product sub-chambers 26 adjacent positive electrodes 18 emerges from electrolysis chamber 2 through first end product outlet port 6 as first end product 84, as indicated by arrows 64. First initial product 80 passing through first initial product sub-chambers 26 which are adjacent negative electrodes 16 emerge from electrolysis chamber 2 through second end product outlet port 8 as second end product 86, as indicated by arrows 66.

Third end product 88 emerges from second initial product sub-chambers 30 into third end product manifold 54, and thence through third end product outlet port 14 and into second initial product reservoir 32, as indicated by arrows 68.

Thus, each first initial product sub-chamber 26 adjacent a positive electrode 18 communicates with first end product manifold 50, which in turn communicates with an exterior of electrolysis chamber 2 through first end product outlet port 6. Similarly, each first initial product sub-chamber 26 adjacent a negative electrode 16 communicates with second end product manifold 52, which in turn communicates with an exterior of electrolysis chamber 2 through second end product outlet port 8. Finally, each second initial product sub-chamber 30 communicates with third end product manifold 54, which in turn communicates with an exterior of electrolysis chamber 2 through third end product outlet port 14.

As previously mentioned, it is desirable to be able to control the flow rate of first initial product 80 into respective first initial product sub-chambers 26 by means of a flow control valve 40 associated with each first initial product sub-chamber, because this in turn controls the rate of production of first end product 84 and second end product 86.

Figure 5:
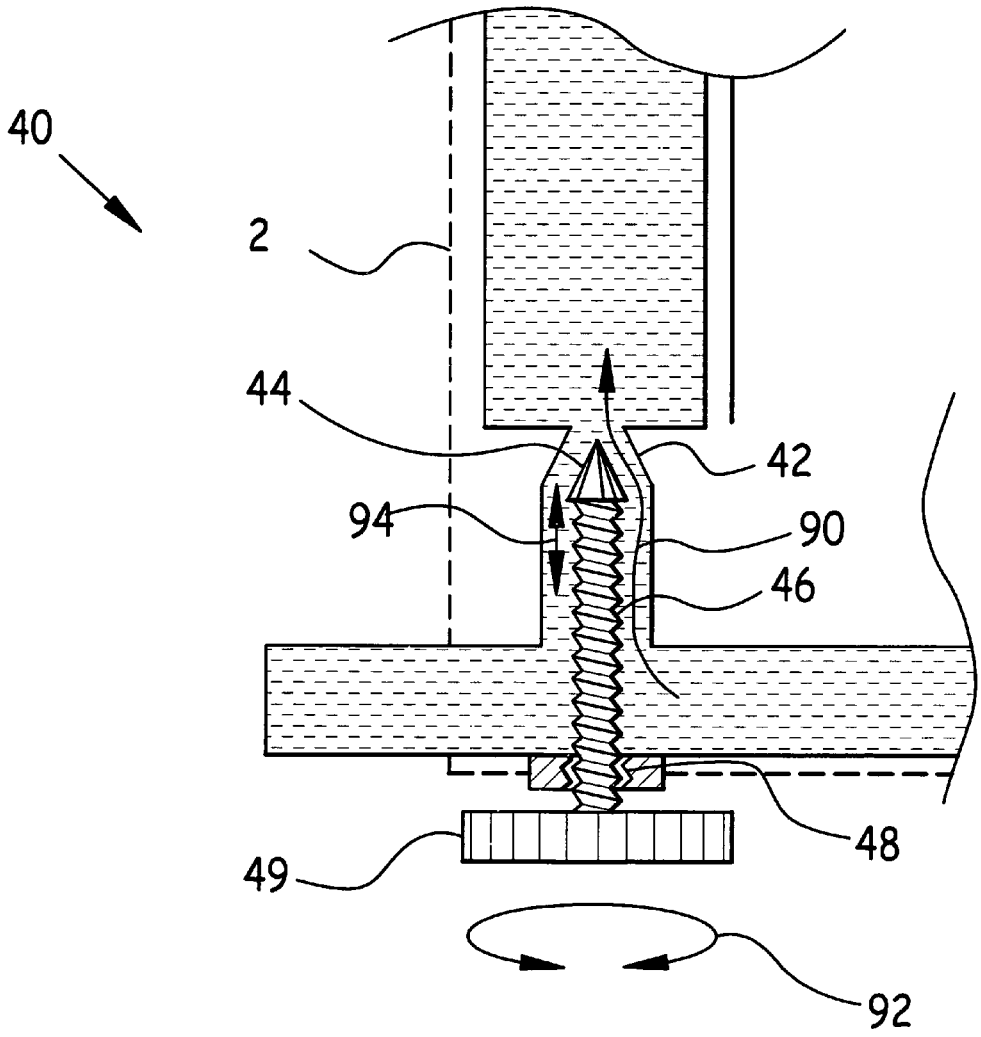
FIG. 5 is a front cross-sectional view of a flow control valve.

FIG. 5 is a front cross-sectional view of flow control valve 40. As may be observed in this figure, flow control valve 40 comprises valve face 44 sized to seat in valve seat 42, threaded rod 46 attached at one end to valve face 44, threaded bore 48 in electrolysis chamber 2 sized to mate with threaded rod 64, and actuator knob 49 attached to an end of threaded rod 48 opposite valve face 44.

In operation, initial product flows into a respective electrolysis sub-chamber as indicated by arrow 90. Rotation of actuator knob 49 as indicated by arrow 92 causes valve face 44 to translate nearer or farther from valve seat 42, as indicated by arrow 94, thus closing or opening valve 40 and setting the flow rate of the initial product into the respective electrolysis sub-chamber.

Figure 4:
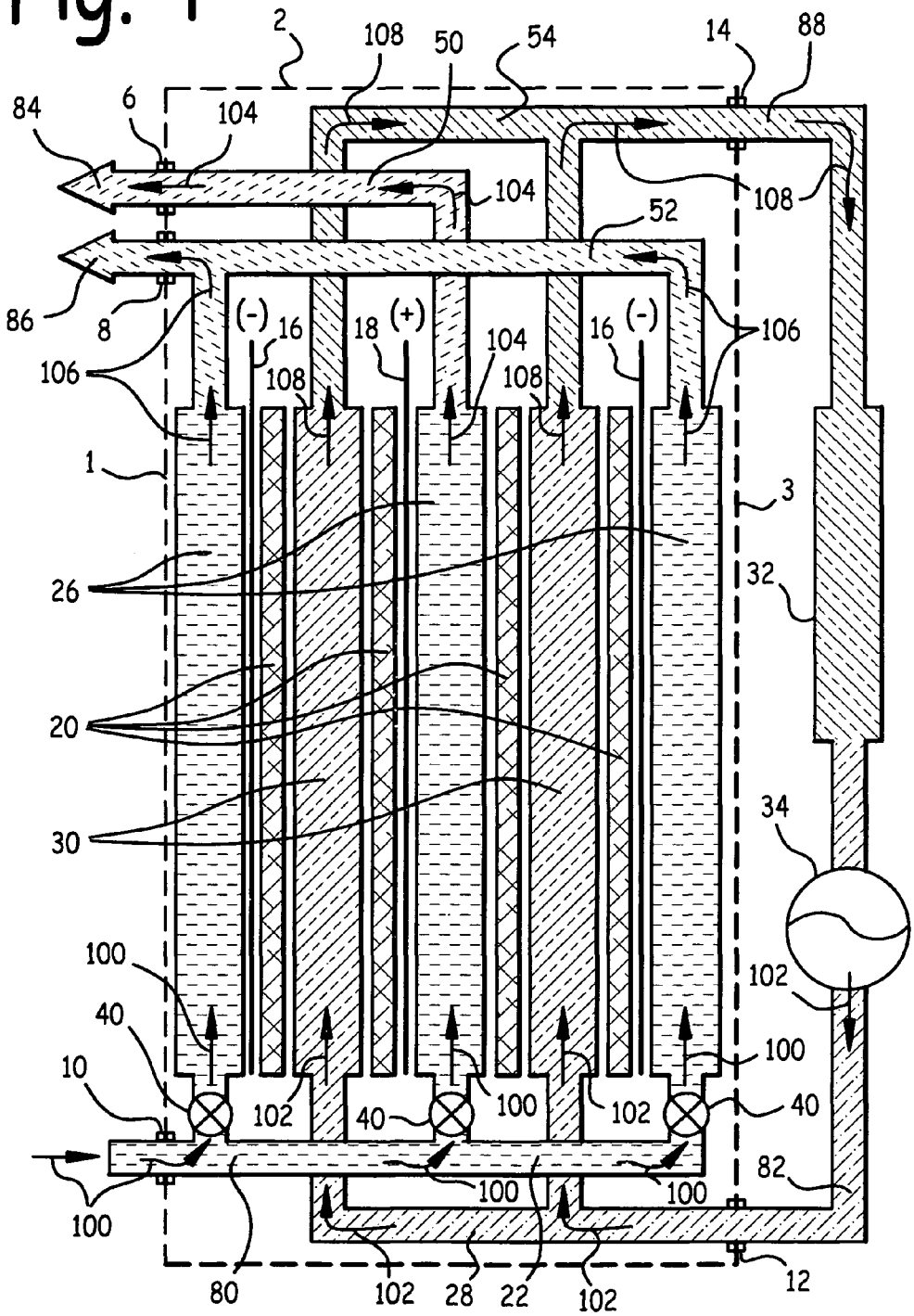
FIG. 4 is a side cross-sectional schematic view of a three-electrode electrolysis chamber, showing passaging between inlet and outlet ports, and sub-chambers.

FIG. 4 is a side cross-sectional schematic view of a three-electrode electrolysis chamber, showing passaging between inlet and outlet ports, and sub-chambers.

The three-electrode electrolysis chamber 2 depicted in FIG. 4 comprises electrodes, electrolysis sub-chambers, and membranes arrayed side-by-side from electrolysis chamber first side 1 to electrolysis chamber second side 3 in the following order: first initial product sub-chamber 26, negative electrode 16, membrane 20, second initial product sub-chamber 30, membrane 20, positive electrode 18, first initial product sub-chamber 26, membrane 20, second initial product sub-chamber 30, membrane 20, negative electrode 16, and first initial product sub-chamber 26.

A single first initial product inlet port 10 provides access from the exterior of electrolysis chamber 2 to first initial product manifold 22. First initial product manifold 22 communicates with a plurality of first initial product sub-chambers 26 through flow control valves 40. One flow control valve 40 is associated with each first initial product sub-chamber 26, and sets the flow rate of first initial product 80 into its respective first initial product sub-chamber 26.

A single second initial product inlet port 12 provides access from the exterior of electrolysis chamber 2 to second initial product manifold 28. Second initial product manifold 28 communicates with a plurality of second initial product sub-chambers 30, so that second initial product 82 may flow through second initial product inlet port 12, second initial product manifold 28, and into second initial product sub-chambers 30.

A single first end product outlet port 6 provides exit for first end product 84 from the first initial product sub-chamber 26 which is adjacent positive electrode 18, through first end product manifold 50. A single second end product outlet port 8 provides exit for second end product 86 from the first initial product sub-chambers 26 which are adjacent negative electrodes 16, through second end product manifold 52. A single third end product outlet port 14 provides exit for third end product 88 from second initial product sub-chambers 30 through third end product manifold 54.

In operation, the three-electrode embodiment depicted in FIG. 4 is analogous to the operation of the four-electrode embodiment described above. First initial product 80 is supplied from a source external to electrolysis chamber 2 through first initial product inlet port 10 and first initial product manifold 22 and into first initial product sub-chambers 26 as indicated by arrows 100. Second initial product 82 is pumped by pump 34 from second initial product reservoir 32 into second initial product manifold 28, and from thence into second initial product sub-chambers 30 as indicated by arrows 102.

In each electrolysis sub-chamber, the initial products are electrolyzed into end products, and the specific end product flowing from each first initial product sub-chamber 26 depends on the polarity of electrode adjacent the specific first initial product sub-chamber 26. First initial product 80 passing through the first initial product sub-chamber 26 which is adjacent positive electrode 18 emerges from electrolysis chamber 2 through first end product outlet port 6 as first end product 84, as indicated by arrows 104. First initial product 80 passing through first initial product sub-chambers 26 which are adjacent negative electrodes 16 emerge from electrolysis chamber 2 through second end product outlet port 8 as second end product 86, as indicated by arrows 106.

Third end product 88 emerges from second initial product sub-chambers 30 into third end product manifold 54, and thence through third end product outlet port 14 and into second initial product reservoir 32 as indicated by arrows 108.

While in interest of clarity the schematic depictions of electrolysis chamber 2 in FIGS. 3 and 4 show boundary lines for sub-chambers 26 and 30, it is intended to be understood that the actual physical walls of sub-chambers 26, 30 are in fact the membranes 30 which border each sub-chamber.

The two representative embodiments illustrated in FIGS. 1-3, and 4, respectively, are not intended to be exhaustive. To the contrary, it is intended to fall within the scope of this disclosure that any desired number of first initial product sub-chambers 26, second initial product sub-chambers 30, positive electrodes 18, negative electrodes 16, and electrolysis membranes 20 be employed. The advantages of providing a single first initial product inlet port 10, a single second initial product inlet port 12, a single first end product outlet port 6, a single second end product outlet port 8, and a single third end product outlet port 14 are preserved regardless of the number of first initial product sub-chambers 26, second initial product sub-chambers 30, positive electrodes 18, negative electrodes 16, and electrolysis membranes 20.

In the preferred embodiment, electrolysis chamber 2 was made of acid and corrosion resistant material such as synthetic, nylon, plastic, or other appropriate material. Electrodes 16, 18 and membranes 30 were made of conventional commercially available electrolysis materials. Electrode contacts 4 and the inlet and outlet ports were commercially available components. Valve 40 was made of synthetic, nylon, plastic, stainless steel, metal, or other appropriate material.

While a preferred embodiment of the invention has been illustrated herein, it is to be understood that changes and variations may be made by those skilled in the art without departing from the spirit of the appending claims.

DRAWING ITEM INDEX

1 electrolysis chamber first side
2 electrolysis chamber
3 electrolysis chamber second side
4 electrode contact
6 first end product outlet port
8 second end product outlet port
10 first initial product inlet port
12 second initial product inlet port
14 third end product outlet port
16 negative electrode
18 positive electrode
20 membrane
22 first initial product manifold
26 first initial product sub-chamber
28 second initial product manifold
30 second initial product sub-chamber
32 second initial product reservoir
34 pump
40 flow control valve
42 valve seat
44 valve face
46 threaded rod
48 threaded rod
49 actuator knob
50 first end product manifold
52 second end product manifold
54 third end product manifold
60 arrow
62 arrow
64 arrow
66 arrow

68 arrow
80 first initial product
82 second initial product
84 first end product
86 second end product
88 third end product
90 arrow
92 arrow
94 arrow
100 arrow
102 arrow
104 arrow
106 arrow
108 arrow

I claim:

1. An electrolysis chamber comprising first initial product sub-chambers, second initial product sub-chambers, positive electrodes, negative electrodes, electrolysis membranes, a first initial product manifold communicating with each said first initial product sub-chamber, and a second initial product manifold communicating with each said second initial product sub-chamber; said electrodes, electrolysis sub-chambers, and membranes being arrayed side-by-side from an electrolysis chamber first side to an electrolysis chamber second side in the following order:

one said first initial product sub-chamber,
one said negative electrode,
one said membrane,
one said second initial product sub-chamber,
one said membrane,
one said positive electrode,
one said first initial product sub-chamber,
one said first initial product sub-chamber,
one said negative electrode,
one said membrane,
one said second initial product sub-chamber,
one said membrane,
one said positive electrode, and
one said first initial product sub-chamber.

2. The electrolysis chamber of claim 1 further comprising a flow control valve associated with each said first initial product sub-chamber, each said flow control valve being disposed between said first initial product manifold and a respective said first initial product sub-chamber, whereby each said flow control valve determines a flow rate of a first initial product into a respective said initial product sub-chamber.

3. The electrolysis chamber of claim 2 further comprising a first end product manifold, a second end product manifold, and a third end product manifold, each said first initial product sub-chamber adjacent one said positive electrode communicating with said first end product manifold, each said first initial product sub-chamber adjacent one said negative electrode communicating with said second end product manifold, each said second initial product sub-chamber communicating with said third end product manifold.

4. The electrolysis chamber of claim 3 further comprising a first initial product inlet port and a second initial product inlet port, said first initial product manifold communicating with an exterior of said electrolysis chamber through said first initial product inlet port, and said second initial product manifold communicating with an exterior of said electrolysis chamber through said second initial product inlet port.

5. The electrolysis chamber of claim 4 further comprising a first end product outlet port, a second end product outlet port, and a third end product outlet port, said first end product manifold communicating with an exterior of said electrolysis chamber through said first end product outlet port, said second end product manifold communicating with an exterior of said electrolysis chamber through said second end product outlet port, and said third end product manifold communicating with an exterior of said electrolysis chamber through said third end product outlet port.

6. An electrolysis chamber comprising first initial product sub-chambers, second initial product sub-chambers, positive electrodes, negative electrodes, electrolysis membranes, a first initial product manifold communicating with each said first initial product sub-chamber, and a second initial product manifold communicating with each said second initial product sub-chamber, said electrodes, electrolysis sub-chambers, and membranes being arrayed side-by-side from an electrolysis chamber first side to an electrolysis chamber second side in the following order:

one said first initial product sub-chamber,
one said negative electrode,
one said membrane,
one said second initial product sub-chamber,
one said membrane,
one said positive electrode,
one said first initial product sub-chamber,
one said membrane,
one said second initial product sub-chamber,
one said membrane,
one said positive electrode, and
one said first initial product sub-chamber.

7. The electrolysis chamber of claim 6 further comprising a flow control valve associated with each said first initial product sub-chamber, each said flow control valve being disposed between said first initial product manifold and a respective said initial product sub-chamber, whereby each said flow control valve determines a flow rate of a first initial product into a respective said first initial product sub-chamber.

8. The electrolysis chamber of claim 7 further comprising a first end product manifold, a second end product manifold, and a third end product manifold, said first initial product sub-chamber adjacent said positive electrode communicating with said first end product manifold, each said first initial product sub-chamber adjacent one said negative electrode communicating with said second end product manifold, each said second initial product sub-chamber communicating with said third end product manifold.

9. The electrolysis chamber of claim 8 further comprising a first initial product inlet port and a second initial product inlet port, said first initial product manifold communicating with an exterior of said electrolysis chamber through said first initial product inlet port, and said second initial product manifold communicating with an exterior of said electrolysis chamber through said second initial product inlet port.

10. The electrolysis chamber of claim 9 further comprising a first end product outlet port, a second end product outlet port, and a third end product outlet port, said first end product manifold communicating with an exterior of said electrolysis chamber through said first end product outlet port, said second end product manifold communicating with an exterior of said electrolysis chamber through said second end product outlet port, and said third end product manifold communicating with an exterior of said electrolysis chamber through said third end product outlet port.

* * * * *